US009926762B1

(12) United States Patent
Kendall et al.

(10) Patent No.: US 9,926,762 B1
(45) Date of Patent: Mar. 27, 2018

(54) DOWNHOLE SEALING APPARATUS

(71) Applicants: Alexander M. Kendall, Houston, TX (US); Jonathan Hanson, Conroe, TX (US); Emily Hanson, Conroe, TX (US); Jason Allen, Houston, TX (US)

(72) Inventors: Alexander M. Kendall, Houston, TX (US); Jonathan Hanson, Conroe, TX (US); Emily Hanson, Conroe, TX (US); Jason Allen, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/349,348

(22) Filed: Nov. 11, 2016

(51) Int. Cl.

| | |
|---|---|
| ***E21B 23/00*** | (2006.01) |
| ***E21B 33/10*** | (2006.01) |
| ***E21B 43/14*** | (2006.01) |
| ***E21B 43/12*** | (2006.01) |

(52) U.S. Cl.
CPC ..... *E21B 33/10* (2013.01); *E21B 43/12* (2013.01); *E21B 43/14* (2013.01)

(58) Field of Classification Search
CPC ..... E21B 33/10; E21B 33/12; E21B 33/1208; E21B 33/1212; E21B 33/1216
See application file for complete search history.

(56) References Cited

U.S. PATENT DOCUMENTS

| | | | | |
|---|---|---|---|---|
| 3,473,814 | A * | 10/1969 | Bastow | F16J 15/166 277/436 |
| 4,349,205 | A * | 9/1982 | McGee | E21B 33/04 277/322 |
| 4,483,543 | A | 11/1984 | Fisher, Jr. | |
| 4,630,833 | A | 12/1986 | Boyle et al. | |
| 5,390,939 | A * | 2/1995 | Terauchi | E21D 11/385 277/648 |
| 5,584,488 | A | 12/1996 | Lembcke | |
| 6,565,093 | B2 | 5/2003 | Crow et al. | |
| 6,843,480 | B2 | 1/2005 | Nelson et al. | |
| 2002/0121743 | A1 * | 9/2002 | Crow | E21B 33/1208 277/343 |
| 2012/0205873 | A1 * | 8/2012 | Turley | E21B 33/1216 277/336 |

* cited by examiner

*Primary Examiner* — Gilbert Y Lee
(74) *Attorney, Agent, or Firm* — Cantor Colburn LLP

(57) ABSTRACT

In one aspect, a seal apparatus for use with a mandrel is disclosed that in one non-limiting embodiment contains a seal housing disposed about the mandrel, wherein the seal housing is spaced apart from the mandrel to form a seal gap, a seal member disposed between the seal housing and the mandrel, wherein the seal member is bonded to the seal housing and the seal member is formed from a first material, and a seal support disposed between the seal housing and the mandrel, wherein the seal support is formed from a second material, wherein the second material is stiffer than the first material, and the seal support extends across the seal gap in response to an energizing force applied to the seal support.

19 Claims, 2 Drawing Sheets

DOWNHOLE SEALING APPARATUS

BACKGROUND

Field of the Disclosure

This disclosure relates generally to seals for use in wellbores.

Background

Wellbores are drilled in subsurface formations for the production of hydrocarbons (oil and gas). Modern wells can extend to great well depths, often more than 15,000 ft. Hydrocarbons are trapped in various traps or zones in the subsurface formations at different depths. Such zones are referred to as reservoirs or hydrocarbon-bearing formations or production zones and further include lower completion tools to control the flow therein. In a multi-zone well bore, it is often desired to seal or isolate certain components or regions while allowing for components to pass through during installation.

The disclosure herein provides a downhole assembly that includes at least one seal, wherein the seal includes an expanding seal support.

SUMMARY

In one aspect, a seal apparatus for use with a mandrel is disclosed that in one non-limiting embodiment contains a seal housing disposed about the mandrel, wherein the seal housing is spaced apart from the mandrel to form a seal gap, a seal member disposed between the seal housing and the mandrel, wherein the seal member is bonded to the seal housing and the seal member is formed from a first material, and a seal support disposed between the seal housing and the mandrel, wherein the seal support is formed from a second material, wherein the second material is stiffer than the first material, and the seal support extends across the seal gap in response to an energizing force applied to the seal support.

In another aspect, a method for providing a seal against a mandrel is disclosed that in one non-limiting embodiment includes providing a seal housing, the seal housing including a seal member and a seal support, wherein the seal member is bonded to the seal housing, the seal member is formed from a first material, the seal support is formed from a second material, and the second material is stiffer than the first material, disposing the mandrel against the seal housing, wherein the seal housing is spaced apart from the mandrel to form a seal gap, the seal member is disposed between the seal housing and the mandrel, and the seal support is disposed between the seal housing and the mandrel, extending the seal support across the seal gap in response to disposing the mandrel against the seal housing.

In another aspect, an isolation system is disclosed that in one non-limiting embodiment contains a tubing, an isolation device associated with the tubing, and a seal apparatus associated with the tubing, the seal apparatus including a seal housing disposed about the tubing, wherein the seal housing is spaced apart from the tubing to form a seal gap, a seal member disposed between the seal housing and the tubing, wherein the seal member is bonded to the seal housing and the seal member is formed from a first material, and a seal support disposed between the seal housing and the tubing, wherein the seal support is formed from a second material, wherein the second material is stiffer than the first material, and the seal support extends across the seal gap in response to an energizing force applied to the seal support.

Examples of the more important features of certain embodiments and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
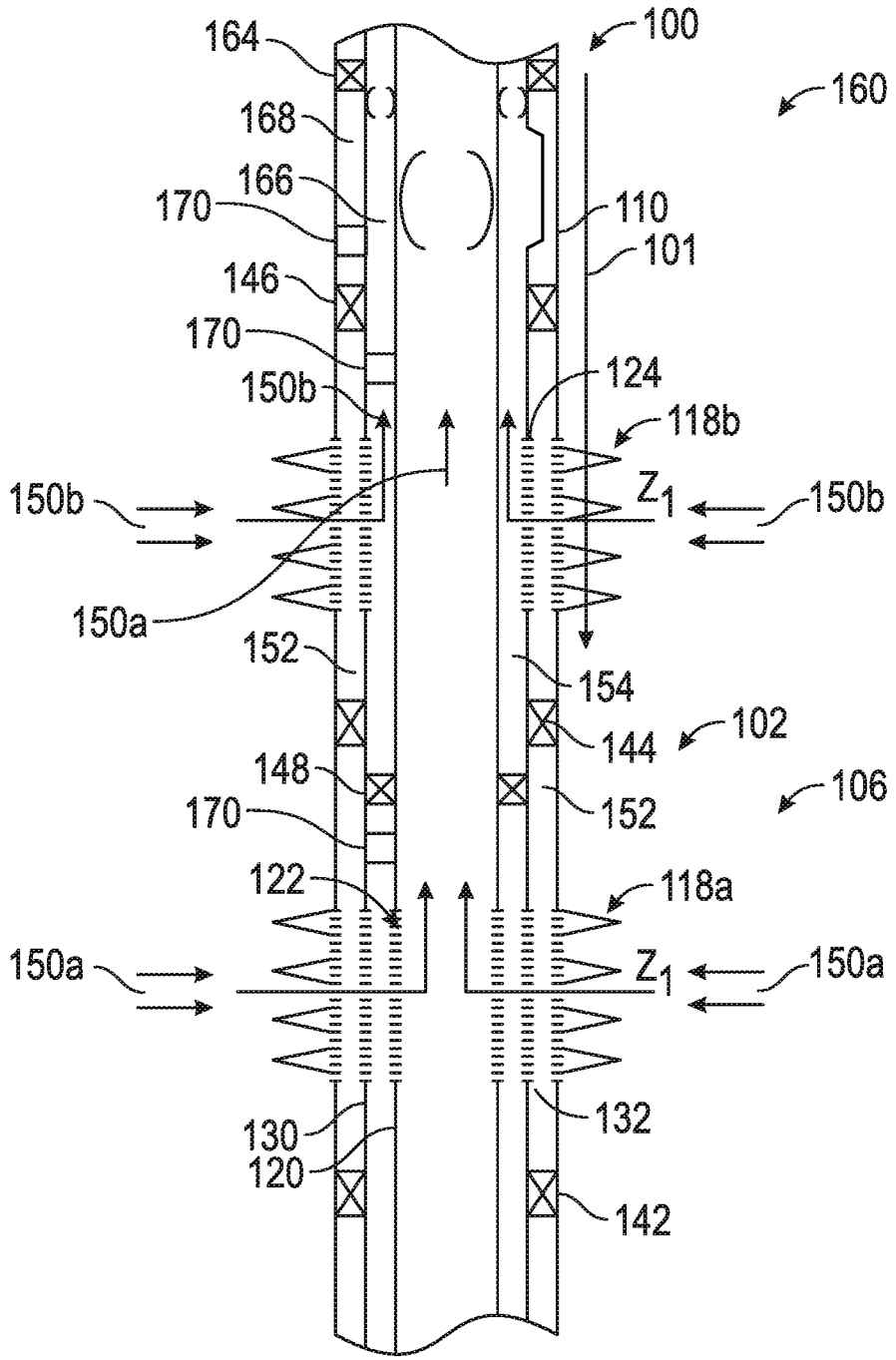
FIG. 1 shows an exemplary cased hole multi-zone wellbore containing a completion system that includes an isolation system and a lower completion system for separately producing fluids from two zones, according to one non-limiting embodiment of the disclosure.

FIG. 1 is a line diagram of a completion system or completion assembly 100 for the production of formation fluids from a multi-zone well, which completion assembly 100 includes a lower completion system 106 and an isolation system 160. The assembly 100 is shown to include a casing 110 deployed in wellbore 101 formed in a formation 102. The formation 102 includes a number of production zones, such zones Z1 and Z2. Perforations 118*a* and 118*b* respectively are formed through the casing 110 into zones Z1 and Z2 to flow the formation fluid 150*a* from zone Z1 into the casing 110 and fluid 150*b* from zone Z2.

The lower completion string 106 includes an inner pipe or tubular 120 and an outer pipe 130. The lower completion system 106 includes a sand screen 132 in lower pipe 130 proximate to the zone Z1 and a sand screen 122 in lower pipe 120 inside and proximate to the sand screen 132. The inner pipe also includes a sand screen 124 in front of the perforation 118*b* in Zone Z2. The lower completion string 106 further includes packers 142 and 144 isolate the annulus 152 between the casing 110 and the outer pipe 130 above and below the perforations 118*a* in zone Z1, while packers 144 and 146 isolate the annulus 152 between the casing 110 and the outer pipe 130 above and below the perforation 118b in zone Z2. In addition, lower completion system 106 includes packer 148 to isolate the annulus 154 between the inner pipe 120 and the outer pipe 130 above the zone Zl. In this manner, fluid 150*a* from zone Z1 flows only into the inner pipe 120 through the perforations 118*a*, sand screens 132 and 122 and fluid 150*b* from zone Z2 enters only into the annulus 154 above the zone Z2. Thus, in the string 100, fluid 150*a* from zone Z1 will flow uphole via the inner pipe 120 while fluid 150*b* from Zone Z2 will flow uphole via the annulus 154 between the inner pipe 120 and the outer pipe 130.

In an exemplary embodiment, isolation system 160 is associated with lower completion system 106 to isolate and control fluid flows 150*a* and 150*b*. Isolation system 160 includes a wet connect 162, packer 164, a first flow control device 166, and a second flow control device 168. Isolation system 160 may be located to associate with the upper end of lower completion 106 and interface with upper packer 146.

In the illustrated embodiment, the isolation system 160 can include one or more seals 170. In the illustrated embodiment, the seals 170 can isolate fluid flow from desired regions or components within the isolation system 160.

Figure 2:
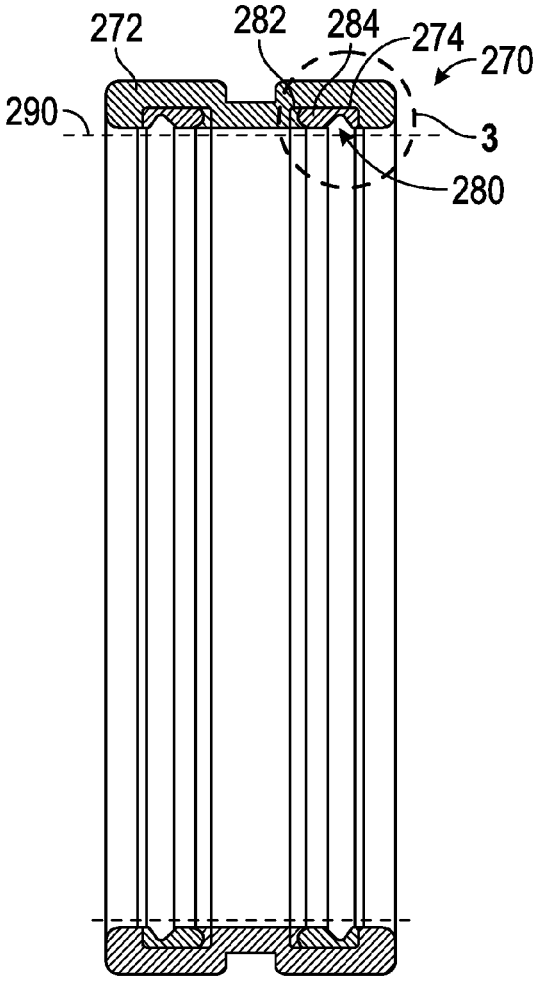
FIG. 2 shows a partial cross section of a non-limiting embodiment of a seal for use with the isolation system shown in FIG. 1.
Figure 3:
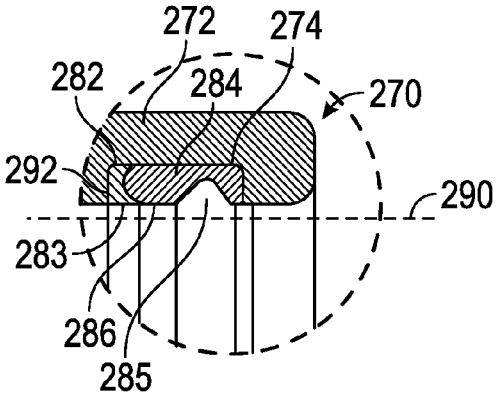
FIG. 3 shows a detail view of the seal components of the seal shown in FIG. 2.

FIGS. 2 and 3 show a seal 270 suitable for use with the isolation system 160 shown in FIG. 1. In the illustrated embodiment, the seal 270 includes a seal housing 272 and seal components 280 including a seal support 282, and a seal member 284. In the illustrated embodiment, the seal 270 can be utilized to seal against a mandrel 290. The mandrel 290 can be stabbed into the seal 270. In certain embodiments, the mandrel 290 is inserted through the seal 270 or slid around the seal 270. In certain embodiments, the seal 270 can be utilized to provide a leak proof seal with isolation systems 160 or any other suitable downhole application. In the illustrated embodiment, the seal support 282 can extend to support the seal member 284 as the seal member 284 is energized to prevent extrusion and other damage to the seal member 284. Advantageously, the seal 270 can be utilized for high pressure and high load applications and can withstand high debris environments.

In the illustrated embodiment, the seal 270 includes a seal housing 272. In the illustrated embodiment, the seal housing 272 is a cylindrically formed housing having an inner diameter and an outer diameter. The seal housing 272 can support the seal components 280 by containing the seal components 280 therein. In certain embodiments, the seal housing 272 is formed from steel, or any other suitable metal. In certain embodiments, the seal housing 272 includes a recessed portion 274. In the illustrated embodiment, the recessed portion 274 is disposed within the inner diameter. In other embodiments, the recessed portion 274 is disposed on the outside diameter of the seal housing 272. The recessed portion 274 can be utilized to retain the seal components 280 therein. In the illustrated embodiment, the seal housing 272 is disposed around the mandrel 290. The seal housing 272 is spaced apart from the mandrel 290 by a seal gap 292 to allow clearance for installation and operation.

Seal components 280 are disposed between the seal housing 272 and the mandrel 290. In the illustrated embodiment, the seal components 280 are disposed within the inner diameter of the seal housing 272. In certain embodiments, the seal components 280 are disposed on the outer diameter of the seal housing 272.

In the illustrated embodiment, the seal components 280 include a seal support 282 and a seal member 284. The seal member 284 is a ring that is disposed within the seal housing 272. In the illustrated embodiment, the seal member 284 is an elastomeric member. In certain embodiments, the seal member 284 is formed from rubber or any other suitable material. In certain embodiments, the seal member 284 is disposed within the recessed portion 274 of the seal housing 272. In certain embodiments, the seal member 284 is bonded to the seal housing 272 to prevent unwanted movement or removal of the seal member 284 from the seal housing 272.

In the illustrated embodiment, before the seal member 284 is energized by either pressure or force of the mandrel 290, the seal member 290 is machined to allow the mandrel 290 to pass therethrough to allow sufficient clearance for installation. In certain embodiments, the seal member 284 is machined to final dimensions after the seal member 284 is placed in the seal housing 272.

In certain embodiments, the seal member 284 includes a circumferential groove 285. The circumferential groove 285 can allow for stress relief during stab in of the mandrel 290 by allowing the seal member 284 to move or compress within the groove 285. In certain embodiments, the circumferential groove 285 is formed by machining the groove into the seal member 284 or otherwise removing material from the seal member 284, to form a groove from an otherwise solid or unitary seal member 284.

In the illustrated embodiment, as the seal member 284 is energized by the movement of the mandrel 290 or by high pressure, seal member 284 moves outwardly to expand and seal against the mandrel 290. In certain embodiments, as the seal member 284 is energized, seal edges 286 can be forced toward the seal gap 292. In certain applications the seal member 284 may be damaged by forcing or extruding the seal edges 286 into the seal gap 292, limiting high pressure applications.

In the illustrated embodiment, the seal support 282 can be utilized to prevent the seal edges 286 from being extruded into the seal gap 292. In the illustrated embodiment, the seal support 282 is a ring that is disposed within the seal housing 272. In the illustrated embodiment, the seal support 282 is formed from a material that is stiffer than the seal member 284 to support the seal member 284 during operation. In the illustrated embodiment, the seal support 282 is formed from a stiff and flexible material. In the illustrated embodiment, the seal support 282 can be formed from polyether ether ketone (PEEK), or any other suitable thermoplastic material, thermoset material, etc. In certain embodiments, the seal support 282 is a non-elastomeric material. In certain embodiments, the seal support 282 is an elastomeric material that is stiffer than the seal member 284. In certain embodiments, the seal support 282 can be fully intact, while in other embodiments, the seal support 282 can be scarf cut. In certain embodiments, the seal support 282 can be formed together with the seal member 284 to form a unitary sealing component 280. In certain embodiments, the unitary sealing component 280 is formed by molding the seal support 282 and the seal member 284 together. Advantageously, by forming the seal support 282 and the seal member 284 from a single piece the unitary sealing component 280 can be inserted into the seal housing 272 as a single element.

In the illustrated embodiment, the seal support 282 is disposed within the recessed portion 274 of the seal housing 272. In certain embodiments, the seal support 282 is bonded to the seal housing 272 to prevent unwanted movement or removal of the seal support 282 from the seal housing 272. In certain embodiments, the seal support 282 is bonded to the seal member 284. In certain embodiments, the seal support 282 includes a retaining feature to remain retained within the seal housing 272. In certain embodiments, the seal support 282 is dovetailed with the seal housing 272.

In certain embodiments, the seal support 282 is inserted into the seal housing 272 before the seal member 284 is disposed within the housing. Similar to the seal member 284, before the seal support is energized by the mandrel 290 or the seal member 284, the seal support 282 is dimensioned to allow the mandrel 290 to pass therethrough to allow sufficient clearance for installation.

In the illustrated embodiment, as the seal member 284 is energized by the movement of the mandrel 290 or by high pressure, the seal member 284 can energize the seal support 282. In the illustrated embodiment, the seal support 282 can deform to expand the expanding portion 283 of the seal support 282. In the illustrated embodiment, the expanding portion 283 is the lower portion of the seal support 282 with a geometry configured to expand downwardly into the seal gap 292 when energized.

The expanding portion 283 can expand across the seal gap 292. In the illustrated embodiment, the seal edges 286 of the seal member 284 can be contained and prevented from extrusion and damage by preventing migration into the seal gap 292. The geometry and the material of the expanding portion 283 can be selected to expand at a desired rate or in relation to the seal member 284. Advantageously, the use of the seal support 282 allows for the use of the seal 270 in higher pressure environments without any damage to the seal member 284.

Therefore, in one aspect, a seal apparatus for use with a mandrel is disclosed that in one non-limiting embodiment contains a seal housing disposed about the mandrel, wherein the seal housing is spaced apart from the mandrel to form a seal gap, a seal member disposed between the seal housing and the mandrel, wherein the seal member is bonded to the seal housing and the seal member is formed from a first material, and a seal support disposed between the seal housing and the mandrel, wherein the seal support is formed from a second material, wherein the second material is stiffer than the first material, and the seal support extends across the seal gap in response to an energizing force applied to the seal support. In certain embodiments, the seal member is contained between the seal support, the seal housing, and the mandrel. In certain embodiments, the seal housing includes a recessed portion, wherein the seal member and the seal support are disposed within the recessed portion. In certain embodiments, the first material is an elastomeric material. In certain embodiments, the second material is PEEK. In certain embodiments, the energizing force applied to the seal support is applied by the mandrel. In certain embodiments, the seal member includes a groove portion. In certain embodiments, the seal support includes an extension portion. In certain embodiments, the seal housing is disposed around the mandrel. In certain embodiments, the seal housing is disposed within the mandrel. In certain embodiments, the seal support is bonded to the seal housing and the seal member.

In another aspect, a method for providing a seal against a mandrel is disclosed that in one non-limiting embodiment includes providing a seal housing, the seal housing including a seal member and a seal support, wherein the seal member is bonded to the seal housing, the seal member is formed from a first material, the seal support is formed from a second material, and the second material is stiffer than the first material, disposing the mandrel against the seal housing, wherein the seal housing is spaced apart from the mandrel to form a seal gap, the seal member is disposed between the seal housing and the mandrel, and the seal support is disposed between the seal housing and the mandrel, extending the seal support across the seal gap in response to disposing the mandrel against the seal housing. In certain embodiments, the seal member is contained between the seal support, the seal housing, and the mandrel. In certain embodiments, the seal housing includes a recessed portion, wherein the seal member and the seal support are disposed within the recessed portion. In certain embodiments, the first material is an elastomeric material. In certain embodiments, the second material is PEEK. In certain embodiments, the mandrel applies an energizing force to the seal support. In certain embodiments, the seal member includes a groove portion. In certain embodiments, the seal support includes an extension portion. In certain embodiments, the seal housing is disposed around the mandrel.

In another aspect, an isolation system is disclosed that in one non-limiting embodiment contains a tubing, an isolation device associated with the tubing, and a seal apparatus associated with the tubing, the seal apparatus including a seal housing disposed about the tubing, wherein the seal housing is spaced apart from the tubing to form a seal gap, a seal member disposed between the seal housing and the tubing, wherein the seal member is bonded to the seal housing and the seal member is formed from a first material, and a seal support disposed between the seal housing and the tubing, wherein the seal support is formed from a second material, wherein the second material is stiffer than the first material, and the seal support extends across the seal gap in response to an energizing force applied to the seal support.

The invention claimed is:

1. A seal apparatus for use with a mandrel, the seal apparatus comprising:

a seal housing disposed about the mandrel, the seal housing including a recessed portion, wherein the seal housing is spaced apart from the mandrel to form a seal gap;

a seal member disposed in the recessed portion, wherein the seal member is bonded to the seal housing and the seal member is formed from a first material; and a seal support disposed in the recessed portion for preventing an edge of the seal member from being extruded into the seal gap, wherein the seal support is formed from a second material stiffer than the first material;

wherein the seal support is outside the seal gap in the absence of an energizing force being applied to the seal support and extends into the seal gap when the energizing force is applied.

2. The seal apparatus of claim 1, wherein the energizing force is applied by a pressure.

3. The seal apparatus of claim 1, wherein the seal member and the seal support form a unitary sealing component.

4. The seal apparatus of claim 1, wherein the seal member is contained between the seal support, the seal housing, and the mandrel.

5. The seal apparatus of claim 1, wherein the first material is an elastomeric material.

6. The seal apparatus of claim 1, wherein the second material is non-elastomeric.

7. The seal apparatus of claim 1, wherein the energizing force applied to the seal support is applied by the mandrel.

8. The seal apparatus of claim 1, wherein the seal support is a solid member.

9. The seal apparatus of claim 1, wherein the seal member includes a groove portion.

10. The seal apparatus of claim 9, wherein the groove portion is formed in the seal member.

11. The seal apparatus of claim 1, wherein the seal support includes an expanding portion that extends into the seal gap when energized.

12. The seal apparatus of claim 1, wherein the seal housing is disposed around the mandrel.

13. The seal apparatus of claim 1, wherein the seal housing is disposed within the mandrel.

14. The seal apparatus of claim 1, wherein the second material is stiffer than the first material.

15. The seal apparatus of claim 1, wherein the seal support is bonded to the seal housing and the seal member.

16. A method for providing a seal against a mandrel, the method comprising:

providing a seal housing, the seal housing including a recessed portion, a seal member, and a seal support that prevents an edge of the seal member from begin extruded into the seal gap, wherein the seal member is bonded to the seal housing, the seal member is formed from a first material, the seal support is formed from a second material, and the second material is stiffer than the first material wherein the seal support is outside the seal gap in the absence of an energizing force being applied to the seal support;

disposing the mandrel against the seal housing, wherein the seal housing is spaced apart from the mandrel to form a seal gap, the seal member is disposed in the recessed portion between the seal housing and the mandrel, and the seal support is disposed in the recessed portion between the seal housing and the mandrel; and energizing the seal support to extend the seal support into the seal gap.

17. The method of claim 16, wherein the seal support is extended into the seal gap in response to disposing the mandrel against the seal housing.

18. The method of claim 17, wherein the seal support is extended into the seal gap in response to an applied pressure.

19. An isolation system comprising:

a tubing;

an isolation device associated with the tubing; and a seal apparatus associated with the tubing, the seal apparatus including:

a seal housing disposed about the tubing, the seal housing including a recessed portion, wherein the seal housing is spaced apart from the tubing to form a seal gap;

a seal member disposed in the recessed portion between the seal housing and the tubing, wherein the seal member is bonded to the seal housing and the seal member is formed from a first material; and a seal support disposed in the recessed portion between the seal housing and the tubing for preventing an edge of the seal member from begin extruded into the seal gap, wherein the seal support is formed from a second material stiffer than the first material;

wherein the seal support remains outside the seal gap in the absence of an energizing force being applied to the seal support and extends into the seal gap when the energizing force is applied.

* * * * *